US008424360B2

(12) United States Patent
Peters

(10) Patent No.: US 8,424,360 B2
(45) Date of Patent: Apr. 23, 2013

(54) HYDRAULIC CYLINDER WITH THREE POSITIVE POSITION STOPS

(75) Inventor: Chris E. Peters, Guelph (CA)

(73) Assignee: Magna International Inc., Aurora (CA)

( * ) Notice: Subject to any disclaimer, the term of this patent is extended or adjusted under 35 U.S.C. 154(b) by 724 days.

(21) Appl. No.: 12/510,570

(22) Filed: Jul. 28, 2009

(65) Prior Publication Data

US 2010/0186478 A1 Jul. 29, 2010

Related U.S. Application Data

(60) Provisional application No. 61/084,753, filed on Jul. 30, 2008.

(51) Int. Cl.
*B21J 9/18* (2006.01)

(52) U.S. Cl.
USPC ..... 72/453.02; 72/453.06; 72/453.07; 100/269.09

(58) Field of Classification Search ..... 72/453.01, 72/453.02, 453.06, 453.07, 453.08, 453.18 M; 100/269.06, 269.07, 269.08, 269.09, 269.14, 100/269.18, 269.19; 91/170 R; 137/596.7, 137/625.65
See application file for complete search history.

(56) References Cited

U.S. PATENT DOCUMENTS 3,624,979 A * 12/1971 Przybylski ..... 52/115
3,820,369 A 6/1974 Tominaga et al.
4,308,745 A * 1/1982 Lisitsa et al. ..... 72/453.18
4,312,207 A * 1/1982 Przybyla et al. ..... 72/100
5,014,602 A * 5/1991 Iwata ..... 92/117 A
5,107,693 A 4/1992 Olszewski et al.
5,247,872 A * 9/1993 Hoshi ..... 92/52
5,305,605 A * 4/1994 Cella ..... 60/546
5,410,946 A * 5/1995 Hoshi ..... 92/65
6,014,879 A 1/2000 Jaekel et al.
6,067,830 A 5/2000 Klages et al.
6,341,514 B2 1/2002 Engel et al.
6,463,996 B1 * 10/2002 Streubel et al. ..... 164/441
6,470,789 B1 * 10/2002 Hirano ..... 92/65
6,662,611 B2 12/2003 Janssen et al.
6,672,120 B1 1/2004 Ghiran et al.
6,722,270 B2 * 4/2004 Koyama ..... 100/269.01
6,915,672 B1 7/2005 Ghiran et al.
7,003,995 B2 2/2006 Ghiran et al.
7,080,589 B2 * 7/2006 Beule ..... 91/422
7,159,426 B1 1/2007 Ghiran
7,249,480 B2 7/2007 Ghiran et al.
2009/0308193 A1 * 12/2009 Bader et al. ..... 74/473.11

* cited by examiner

*Primary Examiner* — Edward Tolan
*Assistant Examiner* — Homer Boyer
(74) *Attorney, Agent, or Firm* — Magna International Inc.

(57) ABSTRACT

A hydraulic cylinder is provided which allows for a mount plate, or the like, to be moved between three positions. The mount plate can be positively positioned in any one of three different positions by appropriately supplying or removing pressurized hydraulic fluid to hydraulic fluid ports on the cylinder. The provision of appropriate positive stops corresponding to each desired position avoids the necessity for complex and/or expensive hydraulic control mechanisms. The cylinder is believed to be particularly suited for performing piercing operations, involving a negative pierce, in hydroforming operations.

6 Claims, 4 Drawing Sheets

HYDRAULIC CYLINDER WITH THREE POSITIVE POSITION STOPS

CROSS-REFERENCE TO RELATED APPLICATIONS

This application claims the benefit of U.S. Provisional Application No. 61/084,753, filed on Jul. 30, 2008, entitled "Hydraulic Cylinder With Three Positive Position Stops", the disclosure of which is incorporated herein by reference for all purposes.

FIELD OF THE INVENTION

The present invention relates to a hydraulic cylinder which provides three different positions. More specifically, the present invention relates to a hydraulic cylinder which provides three positive position stops while occupying a relatively small volume.

BACKGROUND OF THE INVENTION

Hydro-forming of steel and other metal hollow members is becoming increasingly common. With hydro-forming the cost of manufacture of hollow members can be reduced, in comparison to conventional stamping, welding and other manufacturing techniques. Further, the quality (strength, tolerances, etc.) of the finished hydro-formed member can exceed the quality of members formed with conventional techniques.

After a member has been hydro-formed, it typically requires a series of additional manufacturing operations and/or forming steps. One common post-forming operation is the need to form one or more apertures in the member and much effort has previously been devoted to forming these apertures in the member via piercing when the formed member is still in the hydro-forming die.

While piercing is now commonly used to form desired apertures in hydro-formed members, difficulties still exist with piercing technologies. In particular, the size of the cylinders required to perform the pierce can restrict the number of apertures that can be formed in any region of the member as insufficient volume may be available to accommodate the cylinders in the region of interest. Further, the quality (shape and/or clean cut of the edges) of the aperture may not be as good as desired.

To address these issues, piercing systems which employ a negative pierce have been developed. In a negative pierce system, the piercing punch is retracted during a portion of the hydro-forming cycle such that the portion of the formed member to be pierced is extruded outward from the formed member. The piercing punch is then extended into the extruded portion to pierce the resulting weakened area and form the desired aperture. By first extruding the portion to be pierced, the force required to perform the pierce is reduced, allowing for a smaller cylinder to be employed for a given sized aperture and allowing for a better quality aperture to be obtained.

While negative pierce operations provide advantages, the configuration and control of conventional hydraulic cylinders to perform negative piercing has proven to be difficult and/or expensive.

It is desired to have a cylinder which provides for three positive positions which can be used for negative piercing or other applications.

SUMMARY OF THE INVENTION

It is an object of the present invention to provide a novel hydraulic cylinder which obviates, or mitigates, at least one disadvantage of the prior art.

According to a first aspect of the present invention, there is provided a hydraulic cylinder operable to move a mount plate, or the like, between three positions, the cylinder comprising: a drive piston to which the mount plate can be fastened; a support piston; a housing receiving each of the drive piston and the support piston and forming a first hydraulic chamber adjacent the drive piston, a second hydraulic chamber adjacent the support piston and a third hydraulic chamber adjacent both of the drive piston and the support piston, each of the first hydraulic chamber, second hydraulic chamber and third hydraulic chamber being in fluid communication with a respective first, second and third hydraulic port; the first hydraulic chamber and the drive piston being configured such that the supply of pressurized hydraulic fluid to the first hydraulic port retracts the drive piston relative to the housing until the drive piston abuts a positive stop inhibiting further retraction of the drive piston; the second hydraulic chamber and the support piston being configured such that the supply of pressurized hydraulic fluid to the second hydraulic port extends the support piston and the drive piston to a mid position relative to the housing where the support piston abuts a positive stop inhibiting further movement of the drive piston; and the third hydraulic chamber and the support piston and drive piston being configured such that the supply of hydraulic fluid to the third hydraulic chamber extends the drive piston, relative to the housing, where the drive piston abuts a positive stop inhibiting further extension of the drive piston.

The present invention provides a hydraulic cylinder which allows for a mount plate, or the like, to be moved between three positions. The mount plate can be positively positioned in any one of three different positions by appropriately supplying or removing pressurized hydraulic fluid to hydraulic fluid ports on the cylinder. The provision of appropriate positive stops corresponding to each desired position avoids the necessity for complex and/or expensive hydraulic control mechanisms. The cylinder is believed to be particularly suited for performing piercing operations, involving a negative pierce, in hydro-forming operations.

This and other objects of the invention can be more fully appreciated from the following detailed description of the preferred embodiments.

BRIEF DESCRIPTION OF THE DRAWINGS

Exemplary embodiments of the invention will now be described in conjunction with the following drawings wherein like numerals represent like elements, and wherein.

DETAILED DESCRIPTION OF THE PREFERRED EMBODIMENTS

Figure 1:
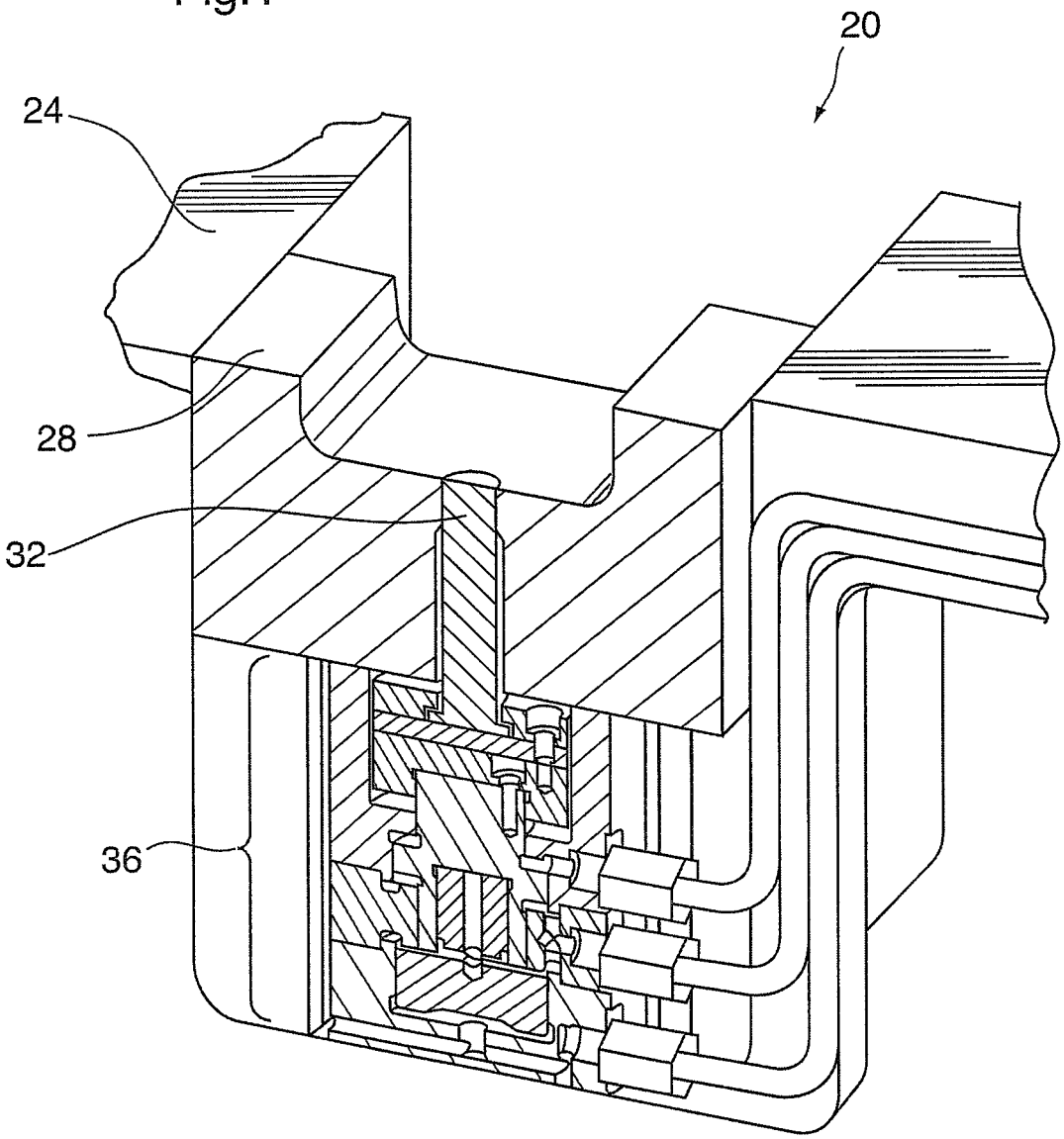
FIG. 1 shows a cross section of a portion of a piercing station in a hydro-forming die in accordance with the present invention.

A hydro-forming apparatus with a piercing station is indicated at 20 in FIG. 1. Apparatus 20 includes a die carrier 24, a hydro-forming die 28 and a piercing station which comprises a piercing punch 32 and a three-position cylinder 36 in accordance with the present invention.

Figure 2:
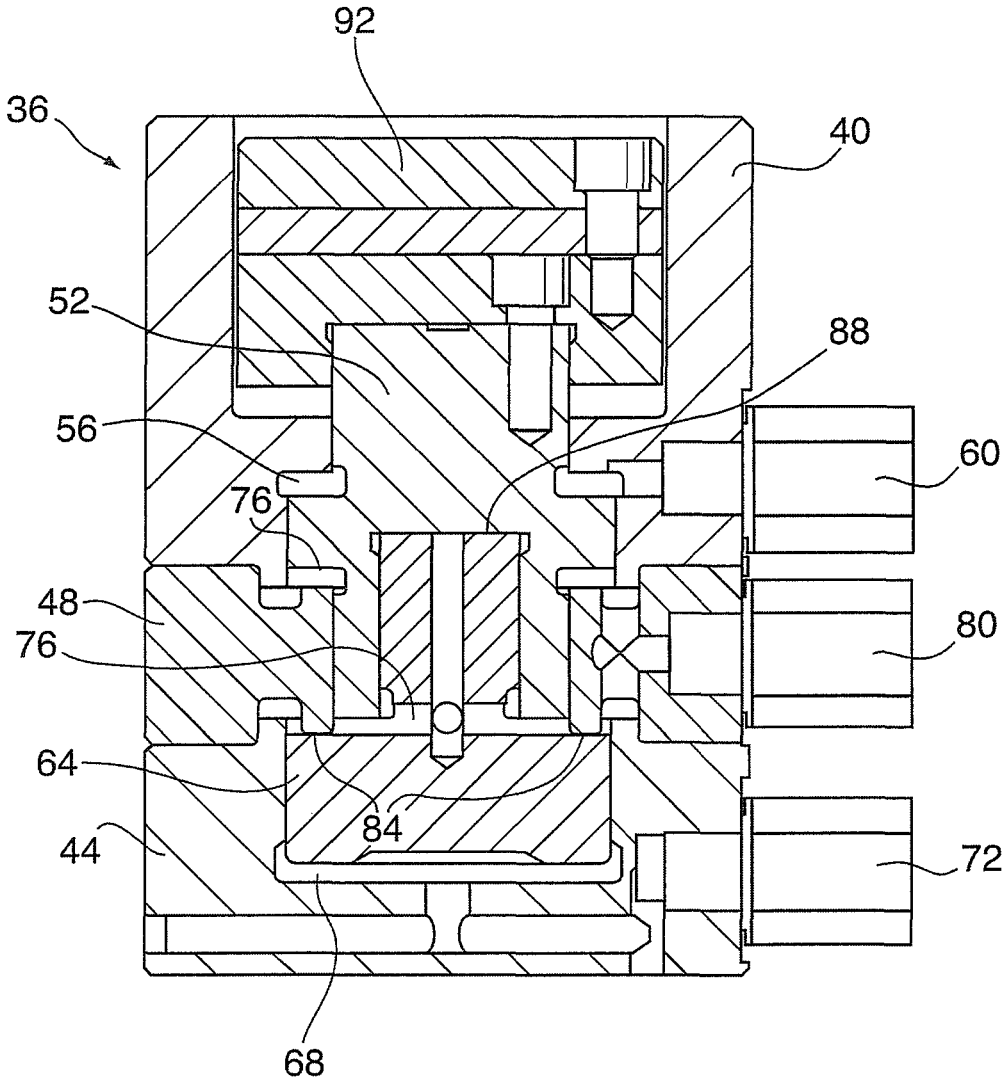
FIG. 2 shows a cross section through a hydraulic cylinder in accordance with the present invention with the cylinder ram in a first position.
Figure 3:
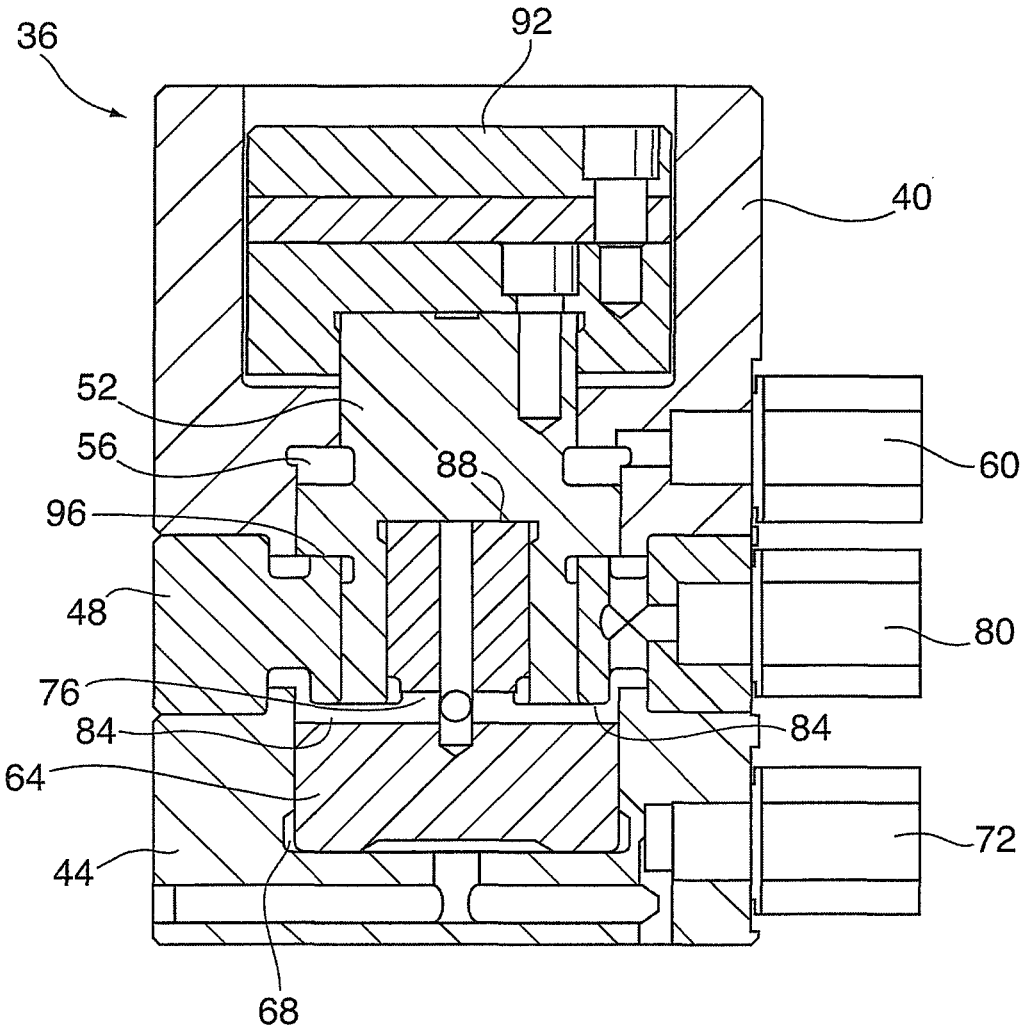
FIG. 3 shows a cross section through the hydraulic cylinder of FIG. 2 with the cylinder ram in a second position.
Figure 4:
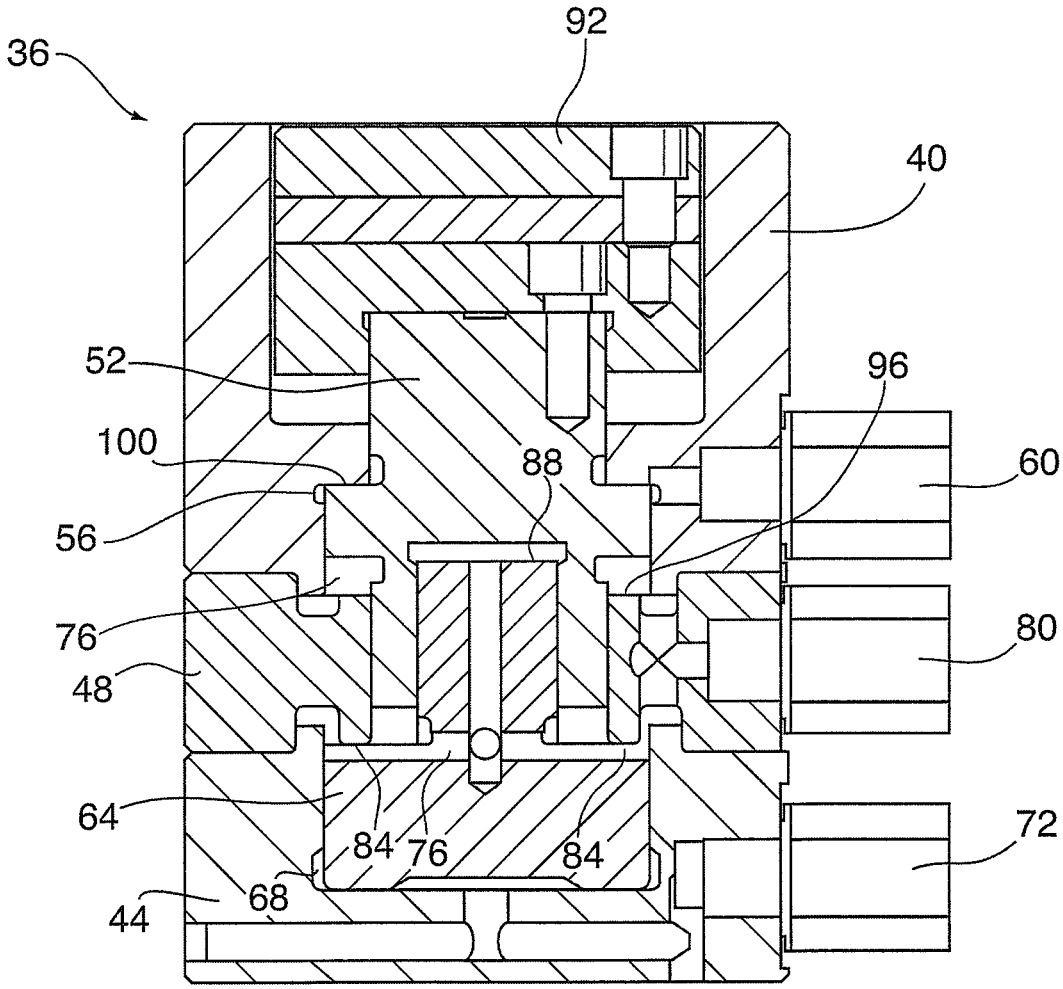
FIG. 4 shows a cross section through the hydraulic cylinder of FIG. 2 with the cylinder ram in a third position.

FIGS. 2 through 4 show cylinder 36 in more detail. Cylinder 36 comprises an upper housing 40, a lower housing 44 and an annular connecting member 48. A drive piston 52 is located within the volume formed by upper housing 40 and annular connecting member 48 and a first hydraulic chamber 56 is formed between upper housing 40 and drive piston 52 and is in fluid communication with a first hydraulic fluid port 60. As will be apparent, when pressurized hydraulic fluid is introduced into first hydraulic chamber 56, drive piston 52 is urged to a retracted position (downward in the Figure).

A support piston 64 is located within the volume formed by lower housing 44 and annular connecting member 48 and a second hydraulic chamber 68 is formed between support piston 64 and lower housing 44 and is in fluid communication with a second hydraulic port 72. When pressurized hydraulic fluid is introduced into second hydraulic chamber 68, support piston 64 is urged to an extended position (upward in the Figure).

A third hydraulic chamber 76 is formed between drive piston 52 and support piston 64 and by annular connecting member 48 and is in fluid communication with a third hydraulic port 80. When pressurized hydraulic fluid is introduced into third hydraulic chamber 76, support piston 64 and drive piston 52 are urged away from each other.

As mentioned above, one of the advantages of cylinder 36 is that it can be positioned, positively, in any one of three positions. Specifically, in FIG. 2 cylinder 36 is shown in a mid-position which is obtained by supplying pressurized hydraulic fluid to second hydraulic port 72 and thus to second hydraulic chamber 68 and depressurizing third hydraulic chamber 76 through hydraulic port 80. The pressurized hydraulic fluid in second hydraulic chamber 68 acts against support piston 64 to urge it toward annular connecting member 48, which it abuts against at surfaces 84 thus acting as a positive stop corresponding to this mid position.

In the event that cylinder 36 is not mounted in the orientation shown in FIG. 2 and drive piston 52 might be extended undesirably by the force of gravity, it is contemplated that pressurized hydraulic fluid (at a reduced pressure relative to the hydraulic fluid introduced into second hydraulic chamber 68) can be supplied to first hydraulic port 60 and to first hydraulic chamber 56 to urge and maintain drive piston 52 in its retracted position. In this case, drive piston 52 will abut support piston 64 at surfaces 88 which act as a positive stop for drive piston 52.

In the circumstance wherein cylinder 36 is employed to perform piercing operations in a hydro-forming system, the mid position illustrated in FIG. 2 would be used to position piercing punch 32 (attached to a mount plate 92 which is, in turn, attached to drive piston 52) in a flush position within hydro-forming die 28 while the hydro-forming of the member is performed.

In FIG. 3, cylinder 36 is shown in a retracted position which is obtained by depressurizing both of second hydraulic chamber 68 and third hydraulic chamber 76 and providing pressurized hydraulic fluid to first hydraulic chamber 56 through hydraulic port 60. The pressurized hydraulic fluid in first hydraulic chamber 56 acts against drive piston 52 to urge it toward annular connecting member 48, which it abuts against at surfaces 96 thus acting as a positive stop corresponding to this retracted position.

In the circumstance wherein cylinder 36 is employed to perform piercing operations in a hydro-forming system, the retracted position illustrated in FIG. 3 would be used to position piercing punch 32 in a negative pierce position within hydro-forming die 28.

In FIG. 4, cylinder 36 is shown in an extended position which is obtained by depressurizing first hydraulic chamber 56 and second hydraulic chamber 68 and providing pressurized hydraulic fluid to third hydraulic chamber 76. The pressurized hydraulic fluid in third hydraulic chamber 76 acts against drive piston 52 (with a reaction force against support piston 64) to extend drive piston 52 until it abuts against surface 100 which acts as a positive stop.

In the circumstance wherein cylinder 36 is employed to perform piercing operations in a hydro-forming system, the extended position illustrated in FIG. 4 would be used to position piercing punch 32 in a positive pierce position within hydro-forming die 28.

As should now be apparent to those of skill in the art, cylinder 36 allows for a mount plate 92, or the like, to be positively positioned in any one of three different positions by appropriately supplying or removing pressurized hydraulic fluid to the three hydraulic fluid ports 60, 72 and 80. The provision of appropriate positive stops corresponding to each desired position avoids the necessity for complex and/or expensive hydraulic control mechanisms. Further, the design of cylinder 36 is compact, occupying a relatively small volume.

The above-described embodiments of the invention are intended to be examples of the present invention and alterations and modifications may be effected thereto, by those of skill in the art, without departing from the scope of the invention which is defined solely by the claims appended hereto.

What is claimed is:

1. A hydraulic cylinder operable to move a mount plate, between three positions, the cylinder comprising:

a drive piston to which the mount plate can be fastened;

a support piston;

a housing comprising an upper housing and a lower housing and receiving each of the drive piston and the support piston and forming a first hydraulic chamber adjacent the drive piston, a second hydraulic chamber adjacent the support piston and a third hydraulic chamber adjacent both of the drive piston and the support piston, each of the first hydraulic chamber, second hydraulic chamber and third hydraulic chamber being in fluid communication with a respective first, second and third hydraulic port;

an annular connecting member disposed between the upper housing and the lower housing, the support piston provided within a volume formed by the lower housing and the annular connecting member;

the first hydraulic chamber and the drive piston being configured such that the supply of pressurized hydraulic fluid to the first hydraulic port retracts the drive piston relative to the housing until the drive piston abuts a positive stop inhibiting further retraction of the drive piston;

the second hydraulic chamber and the support piston being configured such that the supply of pressurized hydraulic fluid to the second hydraulic port extends the support piston and the drive piston to a mid position relative to the housing where the support piston abuts a positive stop inhibiting further movement of the drive piston; and the third hydraulic chamber and the support piston and drive piston being configured such that the supply of hydraulic fluid to the third hydraulic chamber extends the drive piston, relative to the housing, where the drive piston abuts a positive stop inhibiting further extension of the drive piston.

2. The hydraulic cylinder as defined in claim 1, wherein the second hydraulic chamber is formed between the support piston and the lower housing, said second hydraulic chamber being in fluid communication with said second hydraulic port.

3. A hydraulic cylinder operable to move a mount plate between three positions, the cylinder comprising:

a drive piston to which the mount plate can be fastened;

a support piston;

a housing comprising an upper housing and a lower housing and receiving each of the drive piston and the support piston and forming a first hydraulic chamber adjacent the drive piston, a second hydraulic chamber adjacent the support piston and a third hydraulic chamber adjacent both of the drive piston and the support piston, each of the first hydraulic chamber, second hydraulic chamber and third hydraulic chamber being in fluid communication with a respective first, second and third hydraulic port;

an annular connecting member disposed between the upper housing and the lower housing, the drive piston provided within a volume formed by the upper housing and the annular connecting member;

the first hydraulic chamber and the drive piston being configured such that the supply of pressurized hydraulic fluid to the first hydraulic port retracts the drive piston relative to the housing until the drive piston abuts a positive stop inhibiting further retraction of the drive piston;

the second hydraulic chamber and the support piston being configured such that the supply of pressurized hydraulic fluid to the second hydraulic port extends the support piston and the drive piston to a mid position relative to the housing where the support piston abuts a positive stop inhibiting further movement of the drive piston; and the third hydraulic chamber and the support piston and drive piston being configured such that the supply of hydraulic fluid to the third hydraulic chamber extends the drive piston, relative to the housing, where the drive piston abuts a positive stop inhibiting further extension of the drive piston.

4. The hydraulic cylinder as defined in claim 3, wherein the first hydraulic chamber is formed between the upper housing and the drive piston, said first hydraulic chamber being in fluid communication with said first hydraulic port.

5. A hydraulic cylinder operable to move a mount plate between three positions, the cylinder comprising:

a drive piston to which the mount plate can be fastened;

a support piston;

a housing comprising an upper housing and a lower housing and receiving each of the drive piston and the support piston and forming a first hydraulic chamber adjacent the drive piston, a second hydraulic chamber adjacent the support piston and a third hydraulic chamber adjacent both of the drive piston and the support piston, each of the first hydraulic chamber, second hydraulic chamber and third hydraulic chamber being in fluid communication with a respective first, second and third hydraulic port;

an annular connecting member disposed between the upper housing and the lower housing, the support piston provided within a volume formed by the lower housing and the annular connecting member;

the first hydraulic chamber and the drive piston being configured such that the supply of pressurized hydraulic fluid to the first hydraulic port retracts the drive piston relative to the housing until the drive piston abuts a positive stop inhibiting further retraction of the drive piston;

the second hydraulic chamber and the support piston being configured such that the supply of pressurized hydraulic fluid to the second hydraulic port extends the support piston and the drive piston to a mid position relative to the housing where the support piston abuts a positive stop inhibiting further movement of the drive piston; and the third hydraulic chamber and the support piston and drive piston being configured such that the supply of hydraulic fluid to the third hydraulic chamber extends the drive piston, relative to the housing, where the drive piston abuts a positive stop inhibiting further extension of the drive piston, and the third hydraulic chamber being formed between the drive piston and the support piston and the annular connecting member.

6. A hydro-forming apparatus comprising:

a hydraulic cylinder, operable to move a mount plate between three positions, the cylinder comprising:

a drive piston to which the mount plate can be fastened;

a support piston;

a housing comprising an upper housing and a lower housing and receiving each of the drive piston and the support piston and forming a first hydraulic chamber adjacent the drive piston, a second hydraulic chamber adjacent the support piston and a third hydraulic chamber adjacent both of the drive piston and the support piston, each of the first hydraulic chamber, second hydraulic chamber and third hydraulic chamber being in fluid communication with a respective first, second and third hydraulic port;

an annular connecting member disposed between the upper housing and the lower housing, the support piston provided within a volume formed by the lower housing and the annular connecting member;

the first hydraulic chamber and the drive piston being configured such that the supply of pressurized hydraulic fluid to the first hydraulic port retracts the drive piston relative to the housing until the drive piston abuts a positive stop inhibiting further retraction of the drive piston;

the second hydraulic chamber and the support piston being configured such that the supply of pressurized hydraulic fluid to the second hydraulic port extends the support piston and the drive piston to a mid position relative to the housing where the support piston abuts a positive stop inhibiting further movement of the drive piston; and the third hydraulic chamber and the support piston and drive piston being configured such that the supply of hydraulic fluid to the third hydraulic chamber extends the drive piston, relative to the housing, where the drive piston abuts a positive stop inhibiting further extension of the drive piston.

* * * * *